United States Patent [19]

Stinton et al.

[11] 4,253,817

[45] Mar. 3, 1981

[54] CONCRETE RAILROAD TIE CASTING AND HANDLING SYSTEM

[75] Inventors: Frederick M. Stinton, Woodbridge, Canada; William C. Weikert, Fort Worth, Tex.

[73] Assignee: Martin Concrete Engineering Company, Fort Worth, Tex.

[21] Appl. No.: 928,697

[22] Filed: Jul. 27, 1978

[51] Int. Cl.[3] ..... B28B 1/08; B28B 13/02

[52] U.S. Cl. ..... 425/447; 264/261; 264/297; 425/129 R; 425/572; 425/581; 425/588

[58] Field of Search ..... 425/447, 111, 439, 64, 425/115, 129 R, 572, 581, 588; 264/228, 261, 251, 297

[56] References Cited

U.S. PATENT DOCUMENTS

| | | | |
|---|---|---|---|
| 2,394,228 | 2/1946 | Barber et al. | 425/111 |
| 2,397,728 | 4/1946 | Dowsett et al. | 425/111 |
| 3,583,046 | 11/1968 | Dickinson et al. | 425/111 |
| 4,038,355 | 7/1977 | Bratchell | 425/111 |
| 4,051,216 | 9/1977 | Bratchell | 425/111 |
| 4,102,957 | 7/1978 | Da Re | 425/111 |

*Primary Examiner*—Donald J. Arnold

*Attorney, Agent, or Firm*—Hubbard, Thurman, Turner, Tucker & Glaser

[57] ABSTRACT

A system for mass producing prestressed concrete railroad ties using a slip-forming method of casting concrete over a plurality of molds arranged side by side and end to end on a casting bed; a specially equipped continuous casting machine for slip-forming the railroad ties in an upside-down orientation; techniques and equipment for separating and removing finished railroad ties from the casting bed; a plant layout to facilitate casting and handling operations; a specially adapted apparatus for rotating groups of railroad ties to permit stacking thereof in right-side-up orientation.

2 Claims, 20 Drawing Figures

CONCRETE RAILROAD TIE CASTING AND HANDLING SYSTEM

The present invention pertains to high volume concrete casting and handling techniques, and more particularly to methods and apparatus for slip-forming prestressed concrete products of irregular geometry such as concrete railroad ties.

The prestressed concrete crosstie for supporting rails has found wide acceptance in the railroad industry as a substitute for the traditional wooden railroad tie. Until now, however, there has been only limited success in adapting state-of-the-art techniques for mass production of concrete crossties. Although casting by slip-forming has become commonplace in the production of prestressed concrete products that have a regular cross-sectional shape (e.g., building panels, and structural beams and columns), the irregular shape of the industry standard concrete crosstie has heretofore prevented its mass production by slip-forming. Rather, it has been the practice in the prior art to manufacture concrete crossties using conventional wet casting techniques wherein concrete is poured into molds of the desired shape.

Those skilled in the art will appreciate that slip-forming provides many advantages over such conventional wet casting techniques. Wet casting requires full forms around the sides and ends of the concrete product, thereby not only adding to the cost, but also tending to allow air bubbles and voids to form along the sides of the product. Slip-forming, on the other hand, employs moving side forms which tend to eliminate air bubbles and voids by virtue of the traveling effect of the form along the sides of the product being cast. Furthermore, slip-forming permits visual inspection of the sides of the product immediately after casting so that any surface irregularities which occur can be quickly and effectively repaired.

Where the product being cast is a crosstie, prestressed cables must be employed, thus requiring bulkheads and seals at the ends of each form or mold used in a wet cast process. Slip-forming of concrete crossties, however, eliminates all or most of the bulkheads since the ties are formed continuously end to end and later separated by sawing.

An additional advantage of slip-forming is that the very high strength specifications for concrete crossties are more readily achieved using low slump concrete which can readily be slip-formed but is difficult to wet cast due to its relatively low water content.

Accordingly, it is an object of the present invention to provide a system that overcomes the limitations of the prior art that have prevented slip-forming of concrete products having irregular geometries such as railroad crossties.

Another object of the present invention is to provide a plant layout for the mass production and handling of prestressed concrete crossties.

Yet another object of the present invention is to provide a specially adapted continuous casting machine capable of slip-forming a plurality of concrete crossties in closely spaced side-by-side relationship and continuous end-to-end relationship on an elongated casting bed.

These and other objects are accomplished in accordance with the presently most preferred embodiment of the invention by positioning a plurality of molds side by side and end to end on an elongated casting bed, each mold having an upper surface conforming to an irregularly shaped surface of the crosstie to be formed thereon, the upper surface varying in height in the direction of the length of the bed; arranging wire strands in precise patterns over the molds; stressing the wire strands to a predetermined tension; slip-forming concrete material over the molds to the shape of crossties in inverted orientation; allowing the concrete to dry; detensioning the wire strands; and cutting the concrete at the ends of adjacent molds to form separate crossties.

The slip-forming of crossties is performed using a continuous casting machine specially adapted in accordance with the present invention to fluidize low slump concrete to permit slip-forming of crossties in inverted orientation. The machine is equipped with a casting hopper for maintaining a predetermined concrete hydrostatic head pressure, internal vibrators for fluidizing low slump concrete below the casting hopper, a generally horizontal pressure plate rearward from the casting hopper and a plurality of legs extending generally downward from the pressure plate to form the sides of the crossties while slideably and sealably engaging the edges of the molds upon which the crossties are slip-formed.

The novel features believed characteristic of the invention are set forth in the appended claims. The nature of the invention, however, as well as its essential features and advantages, may be understood more fully upon consideration of an illustrative embodiment, when read in conjunction with the accompanying drawings, wherein:

Now referring to the drawings, a presently preferred embodiment of the invention and various modifications thereof will be described in detail, similar reference numerals designating similar parts in the various figures.

Figure 2:
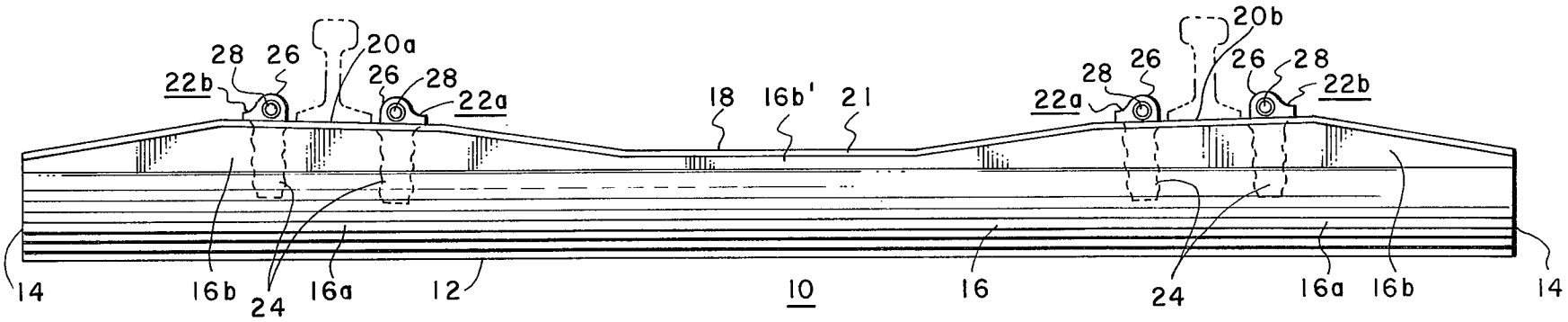
FIG. 2 is a side elevational view thereof.
Figure 1:
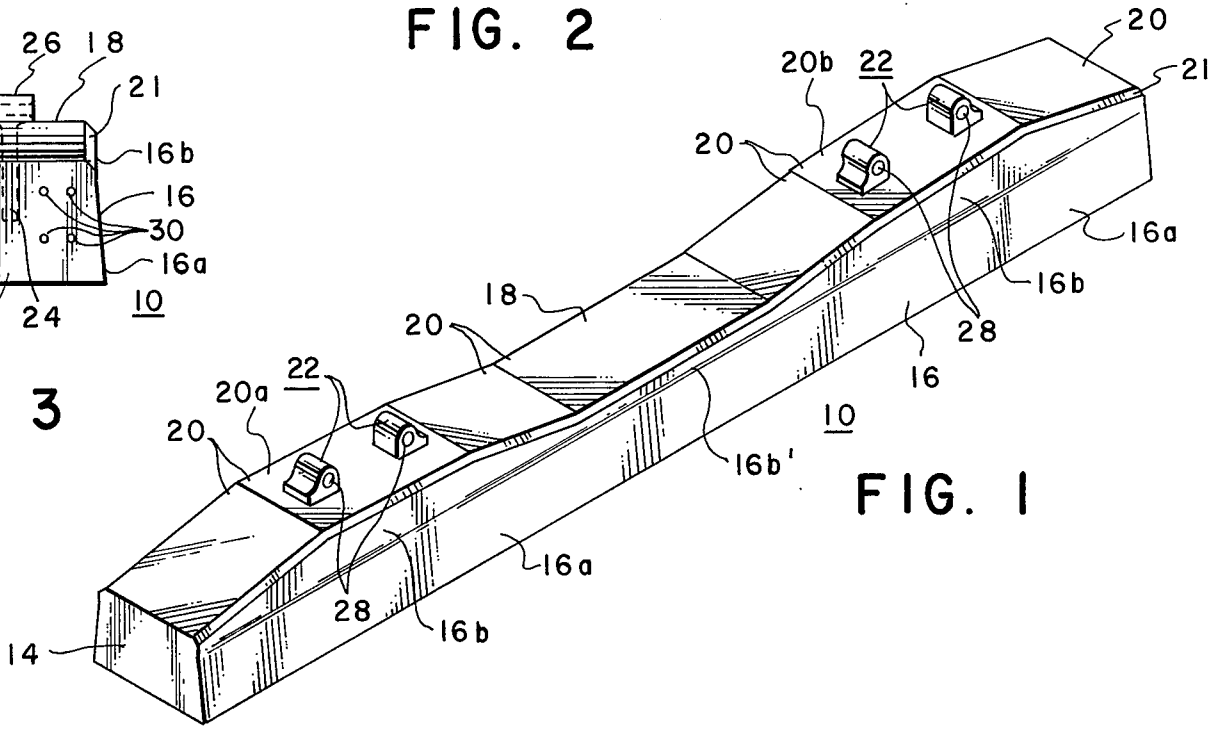
FIG. 1 is a view in perspective of a prestressed concrete crosstie mass produced in accordance with the present invention.
Figure 3:
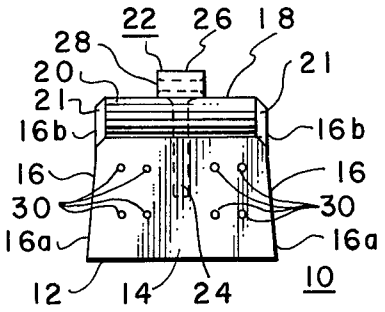
FIG. 3 is an end view thereof.

With reference to FIGS. 1–3, a concrete railroad crosstie, which is mass produced in accordance with the present invention, is designated generally by reference numeral 10. The crosstie 10 has a flat base 12, upstanding ends 14, inwardly leaning sides 16, and a top 18 that gives the crosstie 10 an irregular height dimension varying along its length. The top 18 comprises seven planar surfaces 20 having chamfered edges 21 adjoining the sides 16 as shown. The planar surfaces 20 vary both in orientation and height above the base surface 12. In accordance with a unique feature of the present invention, the sides 16 of the crosstie 10 each have a dual-planar configuration including sloping surface portions **16*a* for optimum stress distribution and vertical surface portions 16b specially adapted to facilitate slip-forming the crosstie 10 using a continuous casting machine, as will become apparent from the following description thereof. Both side surface portions 16*a* and 16*b* extend the entire length of the crosstie 10. The vertical surface 16*b*, which varies in height, is about ½ inch at its narrowest points in the center area denoted as 16*b*′. Although the geometry of the crosstie 10** as illustrated is presently preferred, it will be appreciated from the following description that a variety of alternative shapes can be produced in accordance with the invention to achieve both cost reductions and performance improvements in the state of the art of concrete crossties.

Fastening of the rails (shown in phantom in FIG. 2) to the crosstie 10 is achieved in a conventional manner using iron inserts 22, each rail being mounted between an inner and an outer insert separately denoted in FIG. 2 by the appended letters "a" and "b," respectively. The inserts 22 each have a stem portion 24 (see FIGS. 2 and 3) anchored in the concrete crosstie 10 and a head portion 26 extending out the top 18, each head portion 26 including an eyelet 28 for retaining a rail fastening clip (not shown). The inserts 22 are precisely located in relationship to top surface portions **20*a* and 20*b*, upon which the rails are mounted in the slightly sloped manner shown in FIG. 2. Eight pretensioned wire strands, collectively designated by numeral 30 in FIG. 3, are arranged in a precise pattern for prestressing the crosstie 10** according to conventional techniques to enable it to withstand the superimposed loads of rail traffic. It will be appreciated that various other arrangements and numbers of wire strands can be used with satisfactory results.

Figure 4:
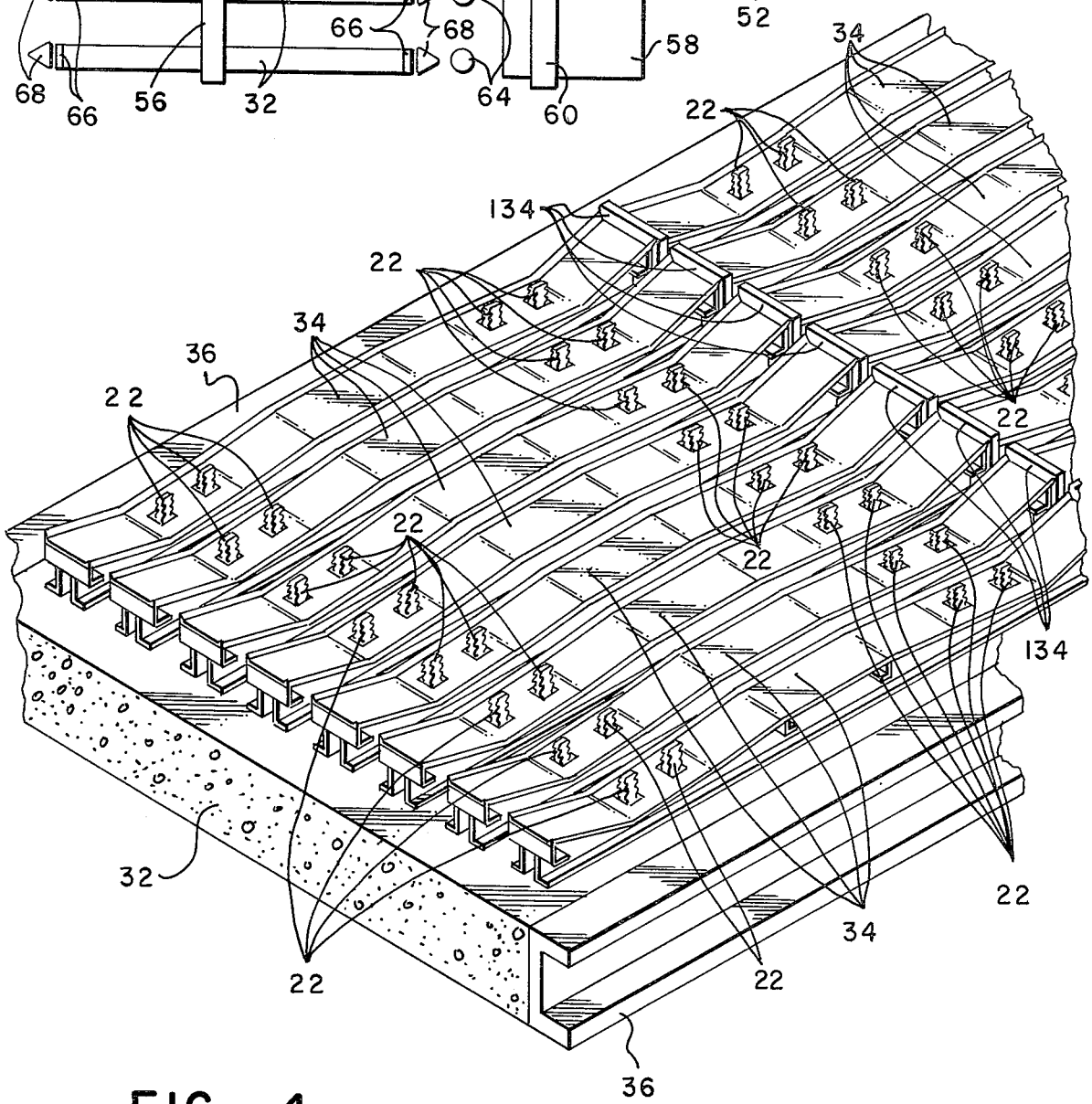
FIG. 4 is a view in perspective of a portion of a casting bed with a plurality of molds arranged thereon in accordance with the inventive system.

Referring to FIG. 4, the crossties 10 are cast side by side and end to end in inverted orientation on a casting bed 32 of several hundred feet in length using a plurality of prearranged molds 34 with inserts 22 installed therein as shown. Mass production of crossties 10 in accordance with the inventive casting system is achieved by slip-forming using a specially adapted continuous casting machine, the pertinent details of which are described below. The casting bed 32 is equipped with C-shaped side channels 36 for guiding such a casting machine along the length thereof.

Figure 5:
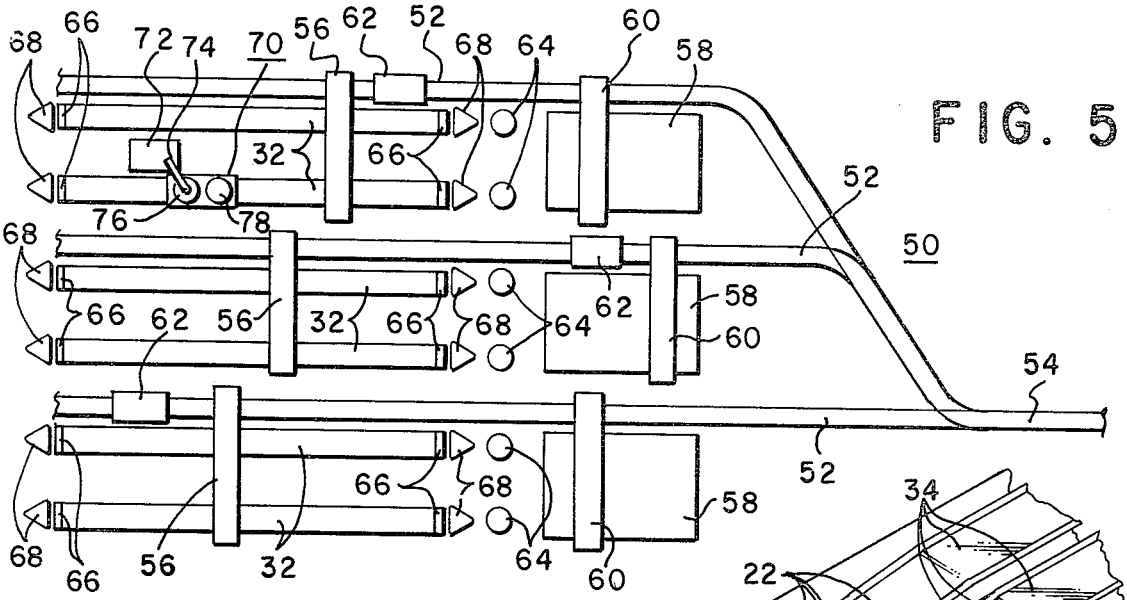
FIG. 5 is a plan view of a plant layout for mass producing concrete crossties in accordance with the inventive system.

Now referring to FIG. 5, a preferred concrete casting plant layout for mass producing crossties 10 is schematically illustrated and designated generally by reference numeral 50. The plant 50 is arranged with pairs of casting beds 32 disposed adjacent to auxiliary rail lines or tracks 52, which are joined to a main track 54, for delivering finished crossties 10 to a railroad system. A first group of overhead cranes 56 is cooperatively disposed in relation to the casting beds 32 such that each crane 56 serves a pair of beds 32 and an adjacent rail line 52. Located at the ends of the beds 32 nearest the main track 54 are stacking areas 58 for temporary storage of crossties 10. A second group of overhead cranes 60 is cooperatively disposed in relation to the stacking areas 58 such that each crane 60 serves one stacking area 58 and an adjacent rail line 52 as shown. Flat bed railroad cars 62 are used to carry finished crossties 10 from the beds 32 to the stacking areas 58.

Prior to casting the crossties 10, wire strands are drawn from coils 64 and strung through heads 66 at opposite ends of each bed 32, the heads 66 being constructed to provide eight precise patterns of wire strands 30 as mentioned above in conjunction with FIG. 3. Hydraulic rams, schematically represented by the triangular shapes 68 in FIG. 5, are then used to pretension the wire strands 30 according to conventional techniques.

Once the wire stands 30 are pretensioned in place over the molds 34 with the iron inserts 22 properly arranged therein, slip-forming of crossties 10 can proceed using a continuous casting machine, schematically illustrated in FIG. 5 and designated by reference numeral 70. The machine 70 is supplied with low slump concrete by a concrete delivery vehicle 72, having a suitable chute 74 for such purpose. By low slump concrete is meant concrete having a slump measurement of less than about two inches as determined in a standard concrete consistency test. The casting machine 70 is equipped with a first hopper 76 for receiving concrete through the chute 74 and a second hopper 78, referred to in the art as a casting hopper, for forming an appropriate hydrostatic head pressure to permit momentary fluidization of the concrete during the casting process. Concrete is transferred from the first hopper 76 to the second hopper 78 by conveyor means as will be described more fully below.

Figure 9:
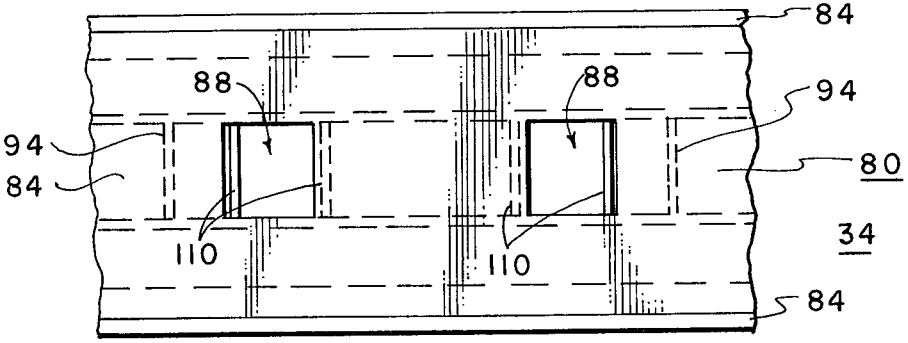
FIG. 9 is a plan view of the portion of the mold shown in FIG. 8.

Now referring to FIGS. 6–9, the details of the presently preferred mold 34 used in the inventive casting system will be described. The mold 34 comprises a casting plate 80, which is supported by an underlying frame 82. The plate 80 has upper surfaces 84 that conform in precise complementary fashion to the top 18 of the crosstie 10. The surfaces 84 are treated with a release agent in a conventional manner prior to casting. The plate 80 has vertical outer edges 86 separated by precisely the same distance as are the opposed vertical surfaces **16*b* of the crosstie 10. Included in the plate 80 at four locations are openings 88, two of which are seen in FIG. 9, for receiving the iron inserts 22 as exemplified in FIG. 4. The inserts 22 are precisely located in the openings 88** in accordance with a unique feature of the present invention to be described below.

Figure 6:
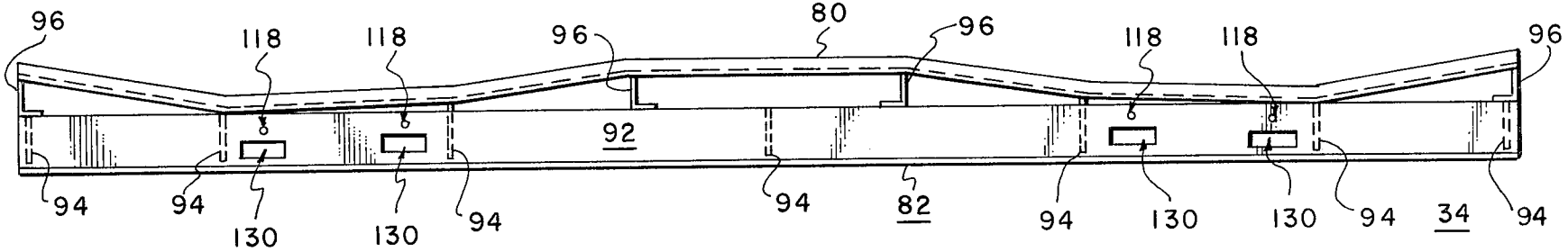
FIG. 6 is a side elevational view of one of the molds shown in FIG. 4.
Figure 8:
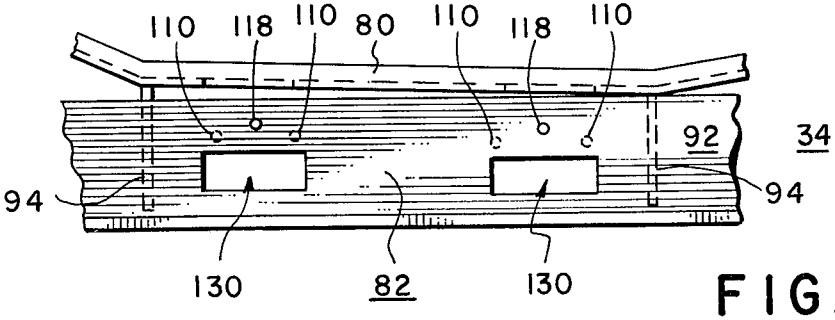
FIG. 8 is an enlarged view of a portion of FIG. 6.
Figure 7:
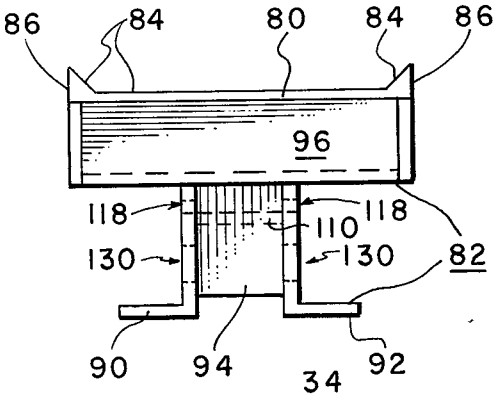
FIG. 7 is an end view thereof.

The frame 82 of the mold 34 comprises first and second supports 90 and 92, which are preferably L-shaped as seen most clearly in the view of FIG. 7. The supports 90 and 92 are mechanically interconnected such as by welding to metal webs 94 located at spaced intervals. Some of the webs 94 conveniently extend above the supports 90 and 92 to engage the casting plate 80 as seen in FIGS. 6 and 8. The casting plate 80 is also supported at spaced intervals as seen in FIG. 6 by L-shaped metal angles 96. The casting plate 80 is preferably supported at its ends and near each of six points along its length where a change in slope occurs.

Figure 10:
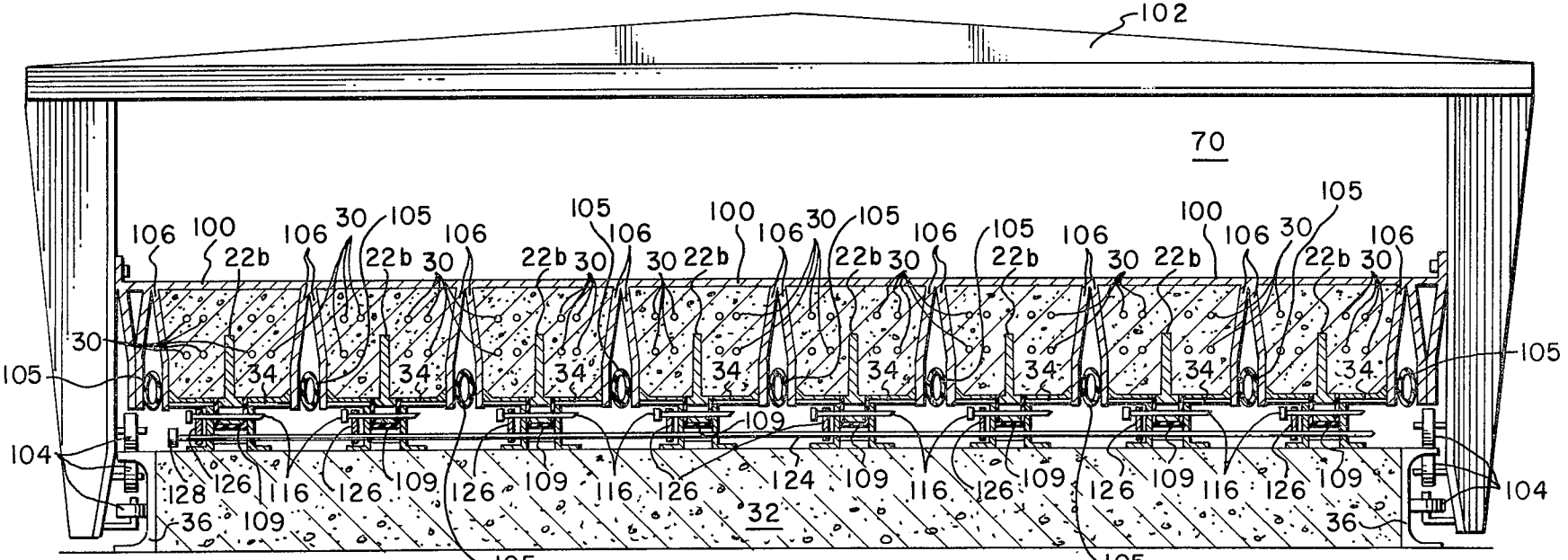
FIG. 10 is a vertical cross section through a portion of a preferred casting machine and underlying molds during casting of concrete crossties on a casting bed.

A preferred method of mass producing crossties 10 will now be described in conjunction with FIG. 10, which schematically illustrates crossties 10 being cast in accordance with the inventive slip-forming technique. The view of FIG. 10 is a cross section taken through a rear pressure plate 100 of the preferred continuous casting machine 70 and underlying molds 34 and casting bed 32 along a line of outer inserts **22*b* looking in a direction toward the ends of the molds 34 nearest the inserts 22*b*. Seen in the background is a frame member 102 equipped with rollers 104 engaging the side channels 36 for supporting and guiding the machine 70 as it travels along the length of the bed 32. The pressure plate 100 is located at a precise height above the bed 32 and rigidly secured to the machine 70 in a suitable manner, such as by attachment to the frame 102 as shown. Rigidly affixed to the pressure plate 100 are downwardly extending legs 106, which resiliently engage the edges 86 of the molds 34 to form a fluid seal therewith. Thus, it will be appreciated that the molds 34 in combination with the pressure plate 100 and legs 106 form a plurality of casting chambers, each of which conforms to the precise outline of a crosstie 10** in inverted orientation.

In accordance with a presently preferred technique, the lower portions of the legs 106 are resiliently forced against the edges of the molds 34 by means of pneumatically operated hoses 105, which are longitudinally disposed along the legs 106 in the manner depected in FIG. 10. Alternatively, the legs 106 can be resiliently forced against the edges of the molds 34 by means of conventional springs (not shown).

Figure 11:
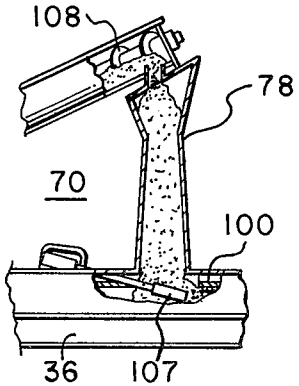
FIG. 11 is a partially sectioned side view of a portion of the preferred casting machine as it moves from right to left on a casting bed illustrating a casting hopper and one of a plurality of stinger vibrators.

A presently preferred technique for fluidizing the concrete in the casting chambers will now be described with reference to FIG. 11, which illustrates the casting hopper 78 and one of a plurality of stinger vibrators 107. The vibrators 107 are located in the concrete below the casting hopper 78 and just ahead of the rear pressure plate 100. The casting hopper 78 is filled with concrete by conveyor means, which preferably comprises an auger 108 equipped to convey the concrete at a controlled rate. The stinger vibrators 107 produce localized internal vibration within the region of concrete below the casting hopper 78 to cause the concrete to become fluidized as it passes under the rear pressure plate 100 to ensure that the casting chambers will be completely filled with concrete as shown in FIG. 10. As the vibrators 107 move away, the concrete becomes less fluidized until it is sufficiently rigid to retain its shape, whereupon it slips out of the casting chambers at the rear of the casting machine 70. It will be appreciated that additional vibrators (not shown) can be employed to advantage up within the casting hopper 78 or downstream from the casting hopper 78 within the casting chambers or both as deemed desirable for the consistency of concrete being cast. It will also be appreciated that a special screed (not shown) can be employed if desired at the downstream end of the pressure plate 100 to give the crossties a striated base surface for improved surface contact with ballast in a railroad bed.

Figure 10A:
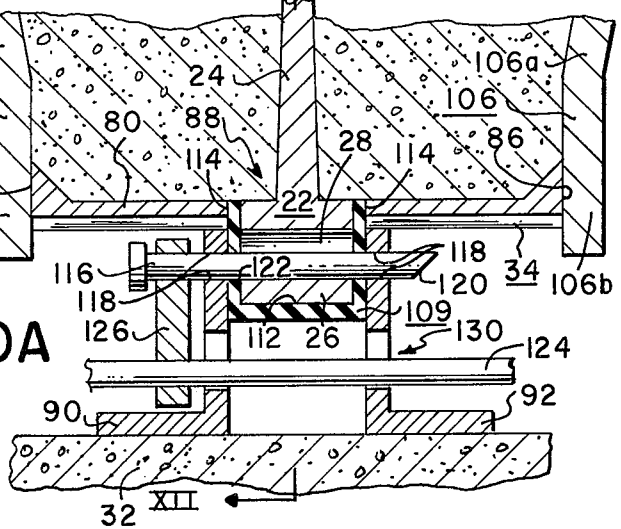
FIG. 10A is an enlarged view of a portion of FIG. 10.

An important feature of the legs 106 is illustrated in greater detail in the enlarged view of FIG. 10A. The legs 106 each have sloping portion **106*a* and a vertical portion 106*b* for forming the respective sloping and vertical surfaces 16*a* and 16*b* of the crossties 10. As the machine 70 moves down the length of the bed 32, the legs 106 slide along the molds 34 such that the variable height edges 86 of the casting plate 80 rise and fall in sliding engagement with the vertical portions 106*b* of the legs 106. Thus, the unique shape of the crosstie 10 shown in FIGS. 1–3 permits slip-forming of the concrete while maintaining a fluid-tight seal at the edges 86 of the casting plate 80**.

Figure 12:
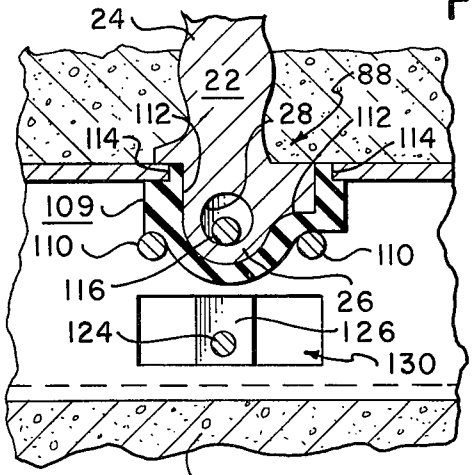
FIG. 12 is a cross section taken along line XII—XII of FIG. 10A.

Now referring to FIG. 12 in conjunction with FIG. 10A, a preferred technique for precisely locating the iron inserts 22 in the openings 88 of the molds 34 will be described. An elastomeric locating and sealing member 109 is placed in each opening 88 as shown, and then the inserts 22 are laid in place therein. The elastomeric member 109 is supported by metal rests 110, which are securely fastened to the L-shaped supports 90 and 92. The member 109 has an inner surface 112 generally conforming to the shape of the head 26, and upper peripheral surfaces 114 tightly conforming to the edges around the opening 88 of the plate 80. Thus, the member 109 serves both to locate the insert 22 and form a surrounding fluid seal with the plate 80. The member 109 preferably comprises a moldable, weather-resistant rubbery polymer such as polyisoprene, polybutadiene, or butadiene-styrene copolymer, but most preferably a polyisoprene such as neoprene.

According to a unique feature of the present invention, the inserts 22 are secured in place in the molds 34 by means of locating pins 116, which also serve to make a fine adjustment for precise positioning of the inserts 22. The supports 90 and 92 are provided with holes 118, seen clearly in FIG. 8, adapted to receive the locating pins 116 at a precise level for positioning the inserts 22 relative to the casting plate 80. Accordingly, the centers of the holes 118 are located at a precise predetermined distance below the sloped surface of the casting plate 80. The elastomeric member 109 is constructed to hold the inserts 22 initially slightly above their final position. Each locating pin has a tapered leading edge 120 as shown in FIG. 10A to facilitate insertion of the pin 116 into the eyelet 28 in its initial offset position. After passing through the first support 90 and the member 109, the leading edge 120 of the pin 116 encounters the insert 22 in the eyelet 28 at a point designated by numeral 122. Then, as the pin 116 is driven into the eyelet 28, the insert 22 is pulled down slightly into proper position. With the pin 116 extending through the hole 118 of the second support 92, the insert 22 is securely held in precisely the proper position by the pin 116 and the elastic force of the member 109.

The locating pins 116 are preferably arranged in gang fashion as seen in FIG. 10, wherein each pin 116 is secured to a control rod 124 by connecting bars 126. The control rod 124 is equipped with a head piece 128 to facilitate mechanical actuation of the rod 124 and gang of locating pins 116. Thus, each row of inserts 22 can be secured and precisely positioned in the molds 34 prior to casting by driving the rod 124 from left to right in the view of FIG. 10 so that the locating pins 116 pass through the supports 90 and 92 and the inserts 22 therebetween. Initial installation of the control rod 124 and gang of pins 116 under the casting plates 80 of adjacent molds 34 is achieved by passing the control rod 124 through elongated openings 130 in the supports 90 and 92. The openings 130 are sufficiently wide to permit the connecting bars 126 to pass therethrough when the rod 124 and gang of pins 116 are oriented 90 degrees from that shown in FIG. 10.

Figure 13:
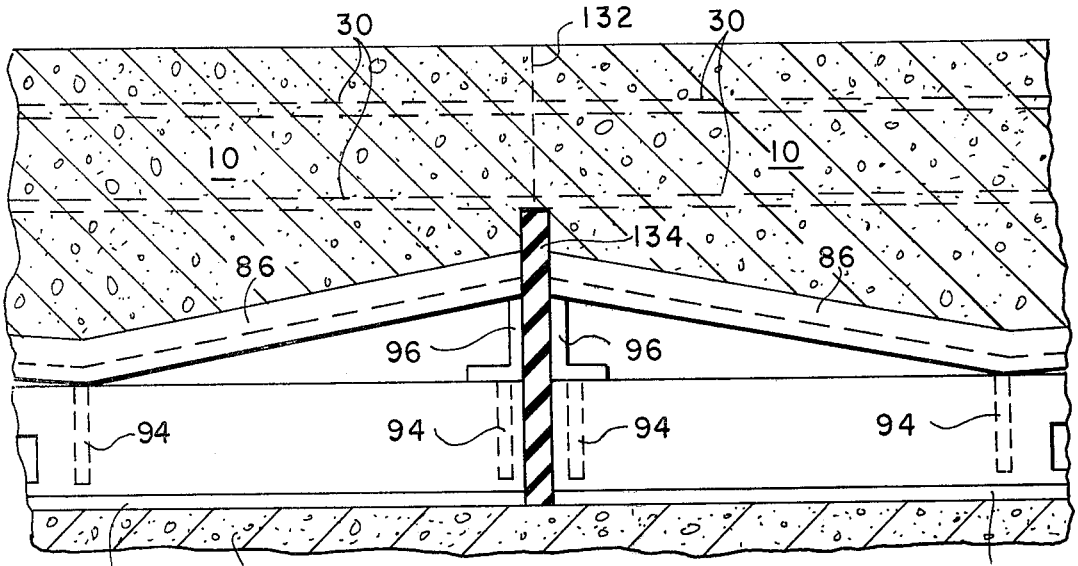
FIG. 13 is a side elevational view of a portion of freshly cast concrete at an end joint between two molds of the type shown in FIG. 6.

In accordance with a unique feature of the present casting system, FIG. 13 illustrates a typical joint at adjacent ends of two molds 34. Freshly cast crossties 10 are shown in integral end-to-end relationship prior to separation by sawing along a line designated by numeral 132. Interposed between the two molds 34 and forming a fluid seal therewith is an elastomeric spacer 134, which preferably comprises a suitable weather-resistant material similar to that of the member 109 described above. The spacer 134 terminates flush with the edges 86 of the casting plates 80 (see also FIG. 4) so as not to interfere with the legs 106 of the casting machine 70 as it slip-forms the concrete crossties 10 in situ thereover in the manner previously described. After the concrete has dried and obtained sufficient strength, the wire strands 30 are detensioned at the ends of the bed 32. The resulting stress applied to the crossties 10 along the length of the bed 32 causes a slight contraction of the concrete, which is compensated for between adjacent molds 34 by contraction of such elastomeric spacers 134. Thereafter, the prestressed concrete is sawed through along each line 132 in accordance with known techniques. The elastomeric spacers 134 preferably extend upward beyond the ends of the molds 34 to abut the lowermost wire strands 30 thereby inducing cracking along the saw line 132.

In an alternative system contemplated by the present invention, conventional bulkheads (not shown) are employed at the ends of some or all of the molds 34, thus permitting those adjacent molds with bulkheads to be spaced apart slightly to compensate for the contraction caused by releasing the stress on the wire strands 30. It will be appreciated that wherever bulkheads are used, it is not necessary to saw through concrete to separate adjacent crossties, but only through the wire strands passing through the bulkheads. At present, it is deemed desirable to provide bulkheads at intervals of fifty to sixty feet and to employ elastomeric spacers at the various other locations between ends of adjacent molds.

Figure 14:
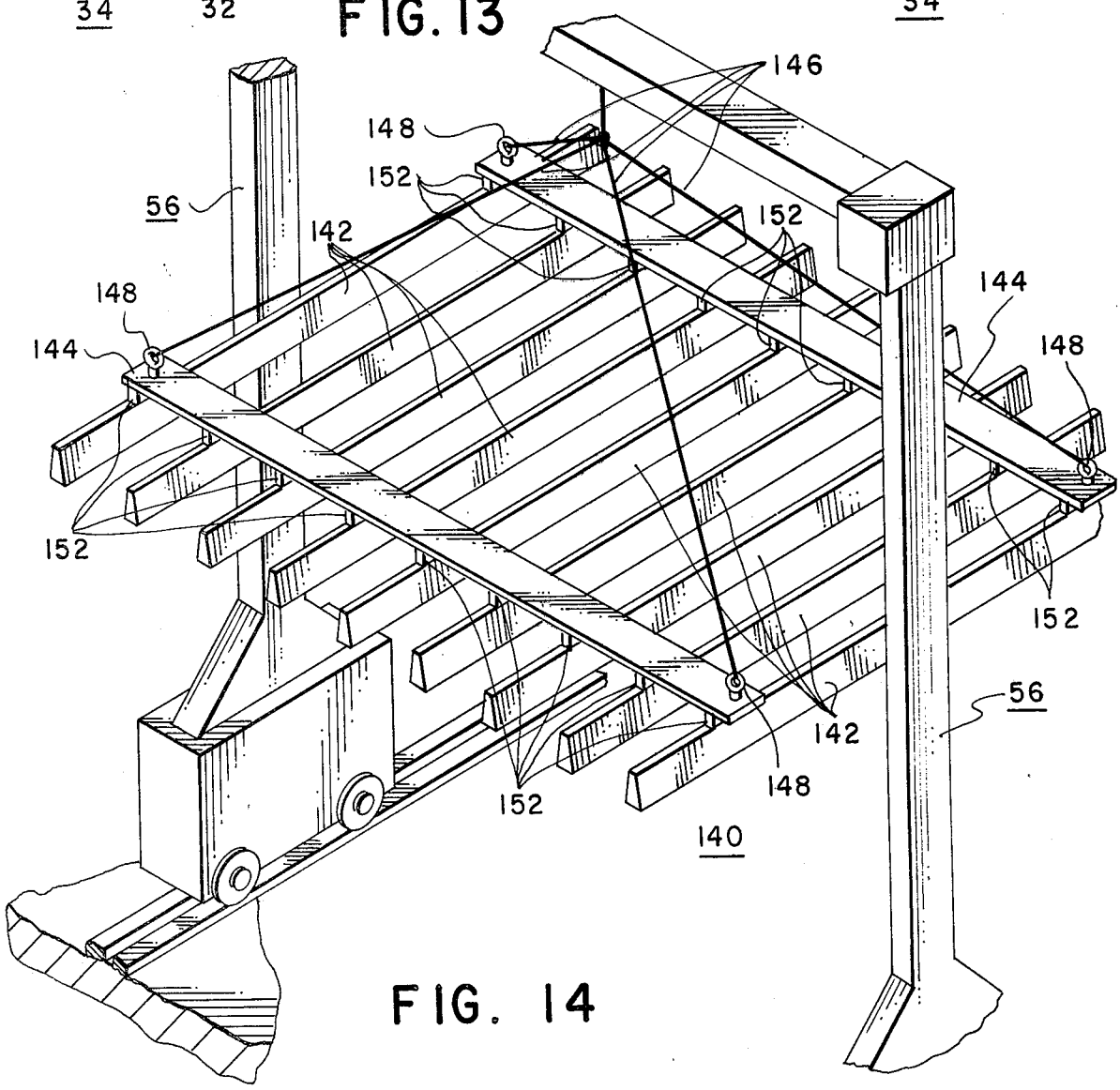
FIG. 14 is a view in perspective of a hoist apparatus for removing concrete crossties from a casting bed.

After separation, the crossties 10 are removed from the casting bed 32 in accordance with another important feature of the present casting system as will now be described in conjunction with FIGS. 14 and 15. Referring in particular to FIG. 14, a unique hoist apparatus, generally designated by reference numeral 140, comprises a plurality of bars 142 assembled in a fork-like configuration. Cross braces 144 support the bars 142 from above and maintain a parallel alignment and precise spacing thereof as shown. The apparatus 140 is equipped to be lifted by one of the overhead cranes 56 in a suitable manner, such as by cables 146 and eye bolts 148, which are preferably secured to opposite ends of the braces 144 as shown.

Figure 15:
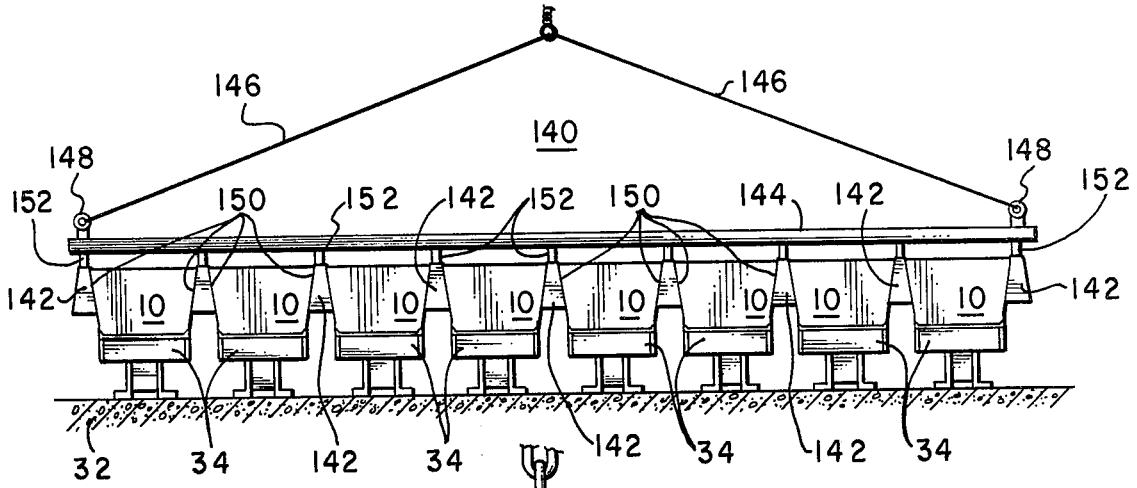
FIG. 15 is an end view of the hoist apparatus of FIG. 14 shown in engagement with eight side-by-side concrete crossties just prior to being lifted from their molds.

With particular reference to FIG. 15, a group of eight finished crossties 10, which have been separated at their ends by sawing, are shown just prior to being lifted out of their molds 34 by the hoist apparatus 140. It will be appreciated that the crossties 10 present handling problems due to their weight, shape and close-packed arrangement on the casting bed 32. In particular, the sawed ends of adjacent end-to-end crossties 10 would be quite difficult to access without widening the space therebetween, which would otherwise be only as wide as the saw blade used to cut the concrete into separate crossties 10. Thus, in accordance with the present casting system, the crossties 10 are removed from the bed 32 using the hoist apparatus 140 by sliding the bars 142 between the free ends of adjacent side-by-side crossties 10 and then lifting the apparatus 140 until the bars 142 engage the sides of the crossties 10. The bars 142 preferably have sloped edges giving them a generally wedge shape configuration such that they conform to the sloping portions of the sides of the crossties 10, as seen in FIG. 15. Thus, a large area interface 150 is formed between each bar 142 and each crosstie 10. When the apparatus 140 is raised using the cables 146, the crossties 10 are lifted out of their molds 34 with the bars 142 contacting only the sides of the crossties 10. Accordingly, it will be appreciated that the hoist apparatus 140 permits removal of crossties 10 from the bed 32 without having to contact the ends 14 of the crossties 10 and without having to move the molds 34 from their original positions. Using the hoist apparatus 140, the bed 32 may be cleared of crossties 10 in groups of eight while working from one end of the bed 32 to the other in a systematic manner. It will be appreciated that the hoist apparatus 140 may be modified for carrying greater or lesser numbers of crossties 10, the number eight being presently preferred as compatible with the above-described casting techniques and equipment.

After the crossties 10 are removed from the casting bed 32, they are loaded on railroad cars 62 for transport to the stacking areas 58 located nearby as depicted in FIG. 5. Once the bed 32 is completely cleared of crossties 10, the molds 34 are returned to their original positions and alignments since, as mentioned above, releasing the stress on the wire strands 30 causes the crossties 10 and molds 34 to move to compensate for the shock of the stress release.

Certain details of the hoist apparatus 140 deserve further exposition. In order that the bars 142 may be slipped between the sides of adjacent crossties 10 without jamming, attachment of the braces 144 to the bars 142 is achieved by extensions 152, which are constructed so that when the bars 142 engage the crossties 10 as shown in FIG. 15, the braces 144 will be positioned a few inches above the crossties 10. The extensions 152 are narrower than the distance between the uppermost edges of the crossties 10, so that the apparatus 140 may be lowered to permit the braces to lie directly on the crossties 10. In addition, the lowermost edge of each bar 142 is narrower than the distance between adjacent molds 34, so that the molds 34 will not interfere with the sliding movement of the bars 142 therebetween when the apparatus 140 is in its lower sliding position.

Figure 16:
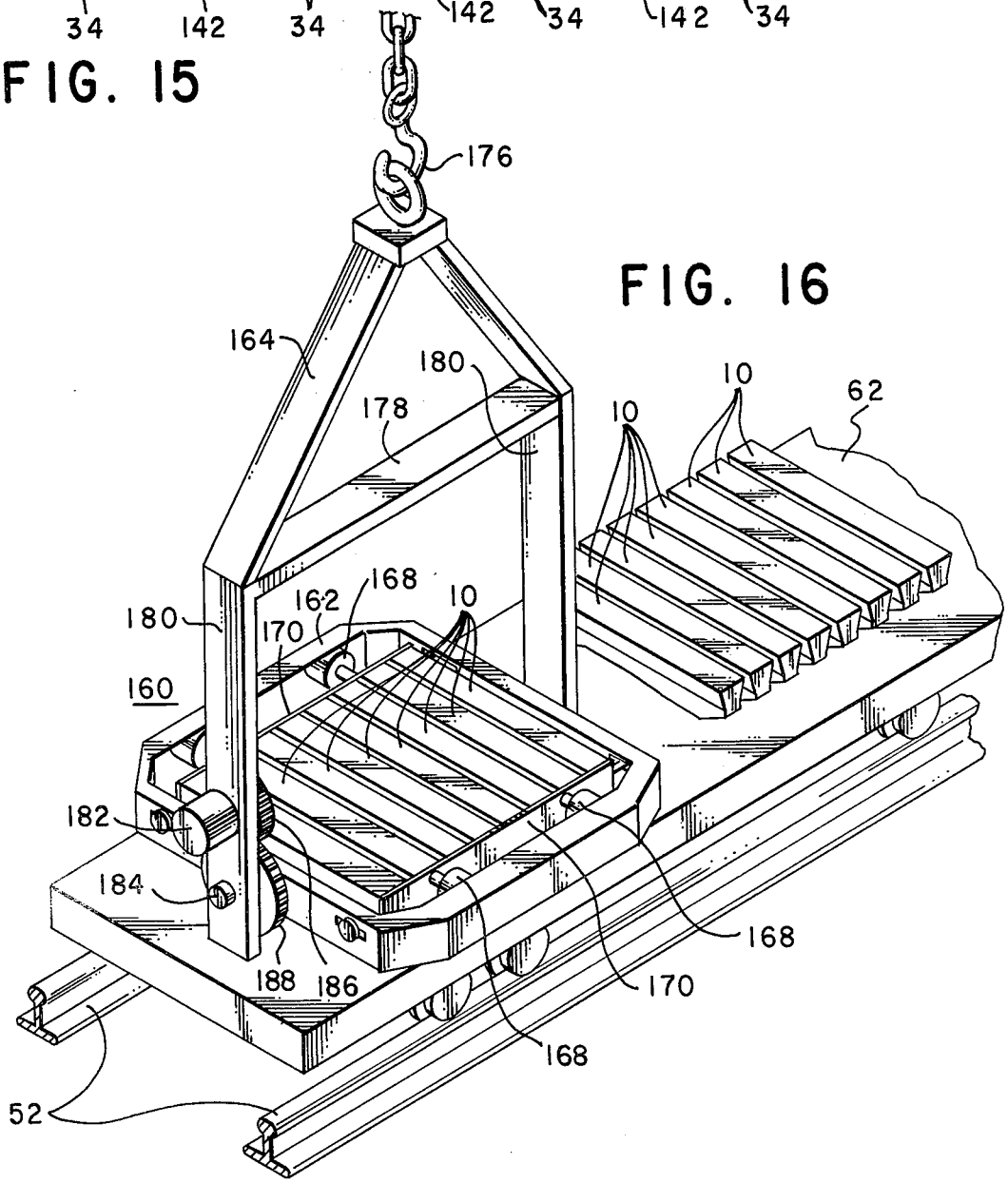
FIG. 16 is a view in perspective of an apparatus for inverting the orientation of a plurality of side-by-side crossties shown on a railroad flat car.
Figure 17:
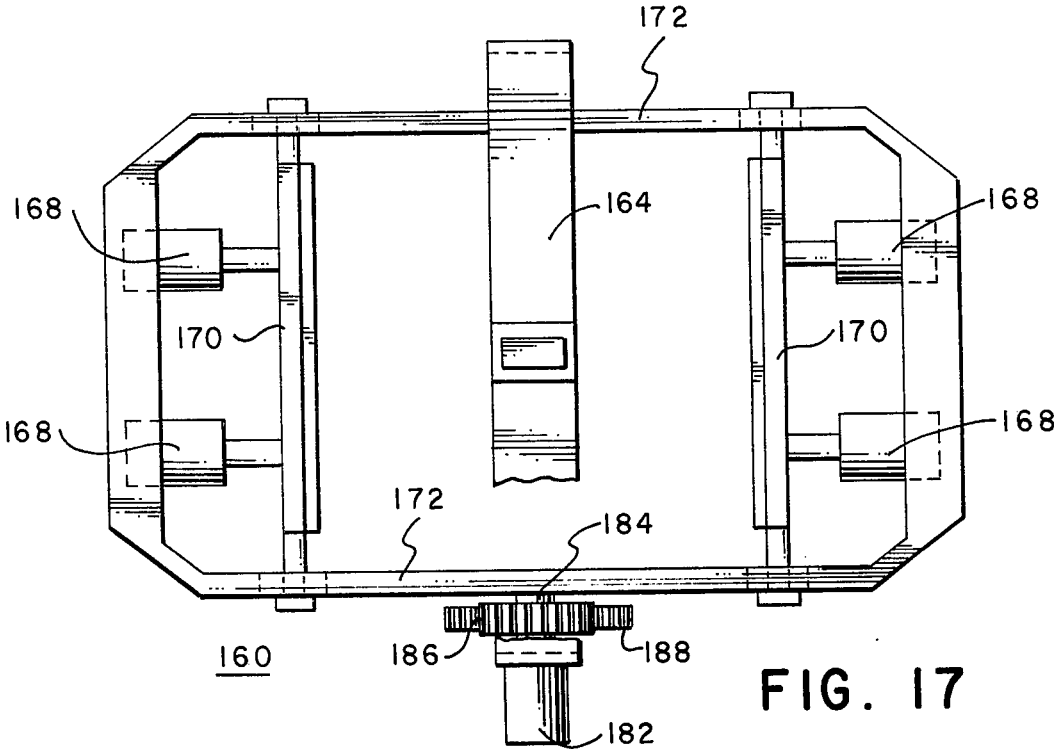
FIG. 17 is a plan view of the apparatus of FIG. 16 shown separately.
Figure 18:
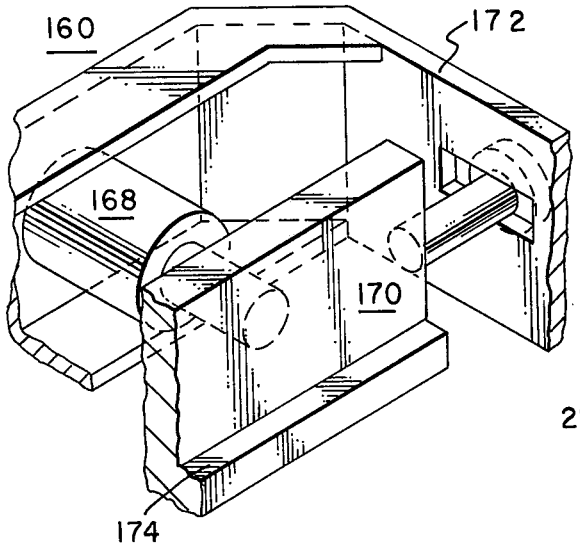
FIG. 18 is an enlarged view in perspective of a corner portion of the apparatus of FIG. 17.
Figure 19:
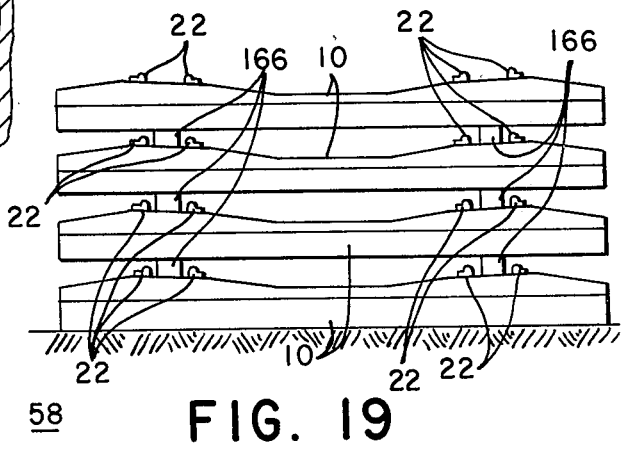
FIG. 19 is a side elevational view of a plurality of crossties stacked atop each other in their end-use orientation.

Now Referring to FIGS. 16–18, a unique apparatus for transporting and inverting the orientation of crossties 10 is illustrated and designated generally by reference numeral 160. The apparatus 160 comprises a frame 162 rotatably mounted in an overhead trussed assembly 164. The frame 162 is equipped to lift a plurality of side-by-side crossties 10 from a railroad car 62, and invert the orientation of the crossties 10 from that shown in FIG. 16 by 180 degrees for stacking in upright orientation in the stacking areas 58 (see also FIG. 5). Groups of eight side-by-side crossties 10 are removed from the railroad car 62, then inverted and stacked atop each other as depicted in FIG. 19 using spacers 166 to prevent damage to the inserts 22.

The procedure for removing the crossties 10 from the railroad car 62 is as follows. The apparatus 160 is first lowered into position with the frame 162 surrounding a group of eight crossties 10 as shown in FIG. 16. Then, hydraulic jacks 168 are actuated to bring plates 170 into contact with the opposite ends of the crossties 10. The plates 170 are slidably mounted in side walls 172 of the frame 162 in a suitable manner. Each plate 170 has a lower lip 174, best seen in FIG. 18, for alignment with respect to the ends of the crossties 10 prior to actuation of the jacks 168. After aligning the lips 174 under the edges of the crossties 10, the jacks 168 cause the plates 170 to be driven forcefully against the ends of the crossties 10 so that the weight of the crossties 10 can be supported by friction alone at the ends thereof. It will be appreciated that each of the crossties 10 of the group of eight are nearly identical in length by virtue of being sawed side by side on the casting bed 32 as discussed above. However, should slight variations in length within groups of crossties 10 prevent adequate friction contacting force with shorter ones of the crossties 10, a hard rubber cushion (not shown) can be installed on each plate 170 for obviating such problems.

With the plates 170 forcefully engaging the ends of the crossties 10, the apparatus 160 is lifted by means of a hook 176 to remove the group of eight crossties 10 from the flat car 62. The trussed assembly 164 that carries the frame 162 is equipped with a cross beam 178 disposed between vertical beams 180 at a height sufficient to permit the frame 162 to be rotated through an angle of 180 degrees, thereby inverting the crossties 10. The frame 162 is caused to be rotated in a suitable manner such as by an appropriately controlled motor 182 disposed at one side of the frame 162 as depicted. The motor 182 is equipped to rotate a shaft 184 using gears 186 and 188, the shaft 184 being axially joined to the frame 162 to provide a balanced load. When the frame 162 has been rotated by 180 degrees to invert the orientation of the crossties 10, the frame 162 is lowered into position over the stacking area 58 so that the crossties 10 come to rest on the stacking area 58 or on spacers 166 above a previously unloaded group of crossties 10. Then, the jacks 168 release the plates 170 so that the apparatus 160 can be lifted away from the stack of crossties 10 and returned to the flat car 62 for the removal of additional crossties 10. Thus, it will be appreciated that the apparatus 160 is capable of inverting groups of crossties 10 to their end-use orientation during the removal and stacking process just described. It will also be appreciated that, although the above-described sequence of events is preferred, the step of rotating the crossties 10 can be performed at any convenient time in the process as, for example, after stacking during loading of crossties 10 onto railroad cars for shipment from the plant 50 to their place of installation.

Although a preferred embodiment of the inventive casting and handling system has been described in detail, it is to be understood that various changes, substitutions and alterations can be made therein without departing from the spirit and scope of the invention as defined by the appended claims.

What is claimed is:

1. A system for slip-forming concrete crossties, comprising:

an elongated casting bed, a plurality of molds arranged side by side and end to end on the casting bed, each mold having a casting plate supported above the casting bed by a frame, a continuous casting machine movable along the bed while the molds remain stationary, the machine having means for forming a casting chamber above each casting plate, said means making a slidable fluid seal at points of sliding engagement of the casting chamber means with each casting plate as the machine moves along the bed.

2. The system of claim 1 wherein each casting plate has upper surfaces of a variable height above the casting bed in the direction of movement of the casting machine, the upper surfaces conforming to the shape of a top surface of a crosstie formed in inverted orientation thereon.

* * * * *